US007600299B2

(12) United States Patent
Hendrickson

(10) Patent No.: US 7,600,299 B2
(45) Date of Patent: Oct. 13, 2009

(54) TOWEL BAR WITH ESCUTCHEONS

(75) Inventor: Joseph D. Hendrickson, University Heights, IA (US)

(73) Assignee: Custom Hardware Mfg. Inc., Keokuk, IA (US)

( * ) Notice: Subject to any disclaimer, the term of this patent is extended or adjusted under 35 U.S.C. 154(b) by 68 days.

(21) Appl. No.: 11/201,224

(22) Filed: Aug. 10, 2005

(65) Prior Publication Data

US 2006/0032025 A1 Feb. 16, 2006

Related U.S. Application Data

(60) Provisional application No. 60/600,710, filed on Aug. 10, 2004.

(51) Int. Cl.
*E05B 1/10* (2006.01)

(52) U.S. Cl. ..... 16/444; 16/412; 16/415; 16/DIG. 40; 16/DIG. 41

(58) Field of Classification Search ..... 16/444, 16/436, 412, 415, DIG. 40, DIG. 41; 248/251, 248/316.1, 316.8, 224.7, 224.8, 223.31; 211/105.1, 211/119.011, 119.009; 4/576.1, 571.1, 573.1, 4/559, 577.1

See application file for complete search history.

(56) References Cited

U.S. PATENT DOCUMENTS

| | | | | |
|---|---|---|---|---|
| 2,589,516 | A * | 3/1952 | Stelzer | 16/402 |
| 4,413,374 | A * | 11/1983 | Ferdinand et al. | 16/441 |
| 4,616,673 | A * | 10/1986 | Bondar | 137/315.15 |
| 6,371,423 | B1 * | 4/2002 | Miller | 211/123 |
| 6,938,868 | B2 * | 9/2005 | Pence | 248/354.3 |
| 2005/0082849 | A1 * | 4/2005 | Ebert | 292/347 |

FOREIGN PATENT DOCUMENTS

| | | | |
|---|---|---|---|
| DE | 2553497 | A * | 6/1977 |
| FR | 2624180 | A3 * | 6/1989 |
| FR | 2627535 | A2 * | 8/1989 |
| JP | 08327297 | A * | 12/1996 |

* cited by examiner

*Primary Examiner*—Chuck Y. Mah
(74) *Attorney, Agent, or Firm*—McKee, Voorhees & Sease, P.L.C.

(57) ABSTRACT

An escutcheon for use with a clamping assembly to mounting a device to a surface. The escutcheon is placed over an exposed fastener for connecting the two clamping members once connected on opposite sides of the surface. The cover member is an escutcheon for covering direct sight of the fastening member from that side.

18 Claims, 6 Drawing Sheets

TOWEL BAR WITH ESCUTCHEONS

PRIORITY STATEMENT

This application claims priority to U.S. Provisional Patent Application No. 60/600,710, filed Aug. 10, 2004, herein incorporated by reference in its entirety.

BACKGROUND OF THE INVENTION

A. Field of the Invention

The present invention relates to any type of bar or pull other hardware that is mounted to one side of a door or surface and which has hardware that attaches it by clamping to the opposite side of the door, panel, or surface. In particular, the invention relates to a method, apparatus, and system of mounting such a device and finishing the mounting structure on the opposite side of the bar or pull.

B. Prior Art

As can be appreciated, in some instances hardware for doors, walls, or panels is attached by a clamping combination. For example, please refer to FIG. 1 (attached). This arc shaped towel bar 10 has opposite ends 12 and 14. Ends 12 and 14 are flat and have a tapped bore 16 adapted to receive the end of a threaded screw. Towel bar 10 is meant to fit against a surface such as, for example, a glass panel or door (e.g., a shower panel or shower door). To fix towel bar 10 to such a panel, two holes are drilled in the glass panel. On the opposite side of the glass panel a bolt or screw would be positioned in the washer, directed through the hole in the glass, and then threaded into the threaded aperture 16 for both ends 12 and 14 of the towel bar 10. By screwing the screws into apertures 16, towel bar 10 would thus be clamped to the glass panel or door.

As can be further appreciated, the head of the screws on the side of the glass panel opposite towel bar 10 would be visible once the bar is installed. In situations where that side of the panel or door is visible, this detracts from the aesthetic appearance of the combination.

SUMMARY OF THE INVENTION

The present invention relates to a method, apparatus, and system of installing the type of hardware described above which eliminates direct sight of the screw or other attachment hardware for clamping the bar or pull to the surface or panel. In one exemplary embodiment, a cover member is adapted to fit over all or a portion of the screw or fastener and/or all or a portion of a washer or other component that is on the opposite side of the bar or pull. The cover covers direct sight of the fastener and/or that structure.

DETAILED DESCRIPTION OF THE EXEMPLARY EMBODIMENT

For a better understanding of the invention, one specific example will now be described. The example relates to a towel bar adapted to fit on one side of a glass panel or door such as a shower door for a residential bathroom. It is to be understood, however, that the invention has equal applicability to other types of hardware. A few examples include towel bars of other shapes and configurations, shower door handles, and decorative structure that is attached to glass panels or doors, etc. Furthermore, the invention is not limited to glass paneled doors or glass panels. It applies to a mounting structure where the hardware is on one side of some surface and it is attached by clamping through the surface where there is a screw or bolt or other fastener that extends through the surface and into the hardware to clamp it.

With respect to the example shown in FIGS. 1-4, towel bar 10 has opposite ends 12 and 14 which have essentially flat surfaces that are aligned in a plane. Tapped bore 16 extend perpendicularly into ends 12 and 14 of bar 10 from those flat surfaces. Bar 10 is adapted to fit against one side of a surface, here a glass panel or door of sheet or panel form.

Figure 1:
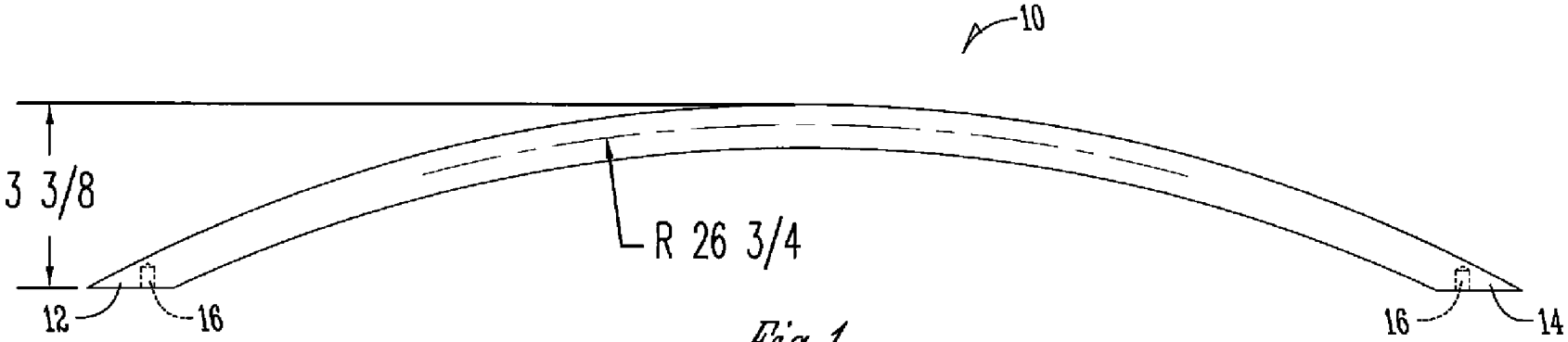
FIG. 1 is a side elevation of a towel bar according to one exemplary embodiment of the present invention.
Figure 2:
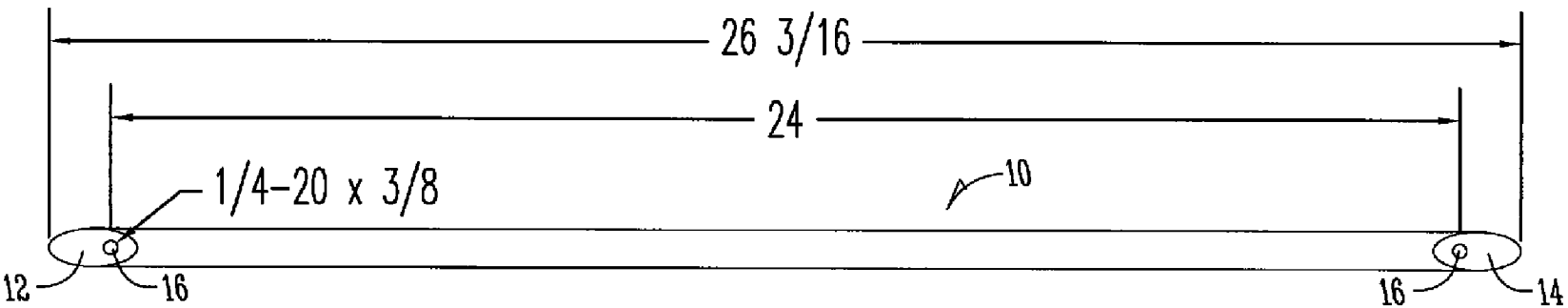
FIG. 2 is a bottom plan view of FIG. 1.

As shown in FIG. 1, bar 10 is arc shaped. It could take any number of different forms or embodiments. FIG. 2 shows bores 16 and indicates this particular thread type and bore size.

Figure 3A:
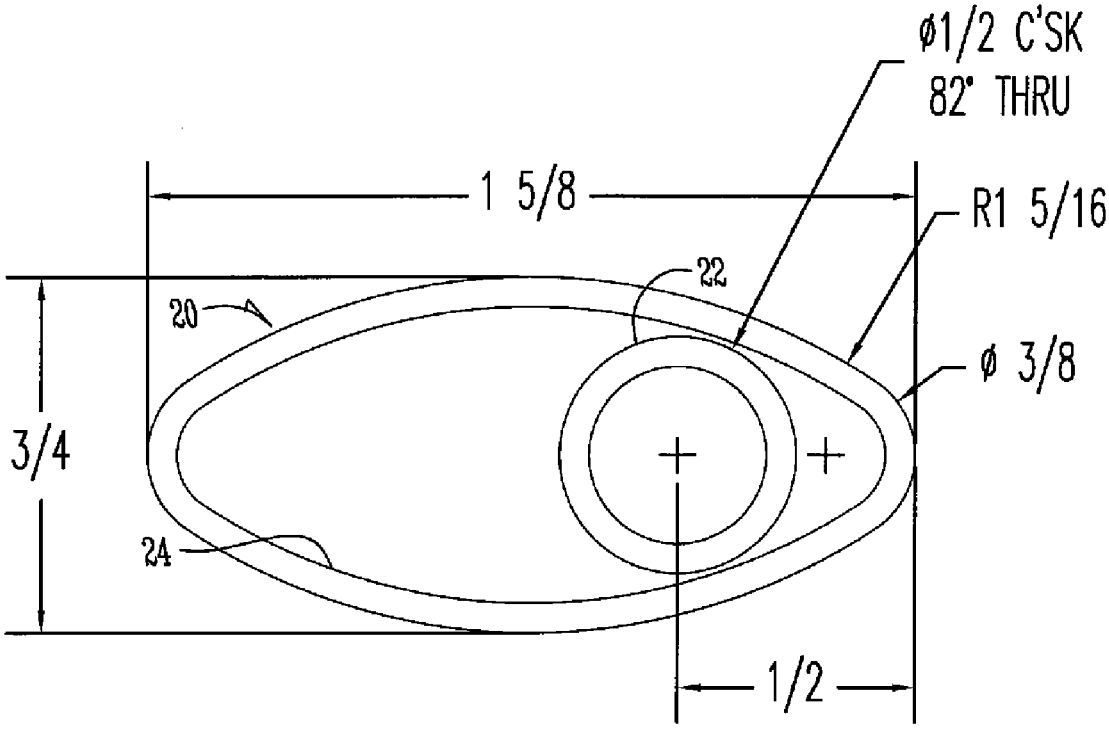
FIG. 3A is a plan view of the outer side of a fastener pad adapted for clamping the towel bar of FIGS. 1 and 2 to a panel or door, on the opposite side of the towel bar.
Figure 3B:
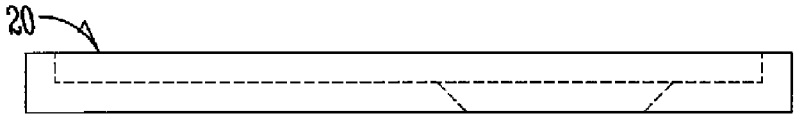
FIG. 3B is a side elevation of FIG. 3A.
Figure 3C:
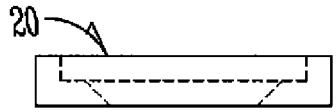
FIG. 3C is an end elevation of FIG. 3A.

FIGS. 3A-C illustrate in detail what will be called a fastener pad 20. It could be made of any number of material (e.g., metal or hard rubber). It needs to be strong enough that it can receive the indicated screw or bolt through the indicated hole (see FIG. 3A) and (with the heads of screws) clamp bar 10 to the glass panel while essentially acting as a clamp on the opposite sides of flattened ends 12 and 14 of bar 10. As can be seen, in this embodiment fastener pad 20 is made of the same oval shape as ends 12 and 14 of bar 10. Two fastener pads 20 L and R (left and right) would be used, one for each end 12 and 14 of bar 10. They would just be rotated 180° from one another to match up their holes 22 with hole 16 in bar 10.

Even though fastener pads 20 are relatively thin (see FIGS. 3B and 3C) and match the shape of ends 12 and 14 of bar 10, the head of the screws used to clamp bar 10 to the surface through pads 20 would be exposed to view. Also, the head of the fastening screw would be exposed to water and the other environmental substances typical for that installation (e.g., cleaning chemicals, soaps, hair products, etc).

Figure 4:
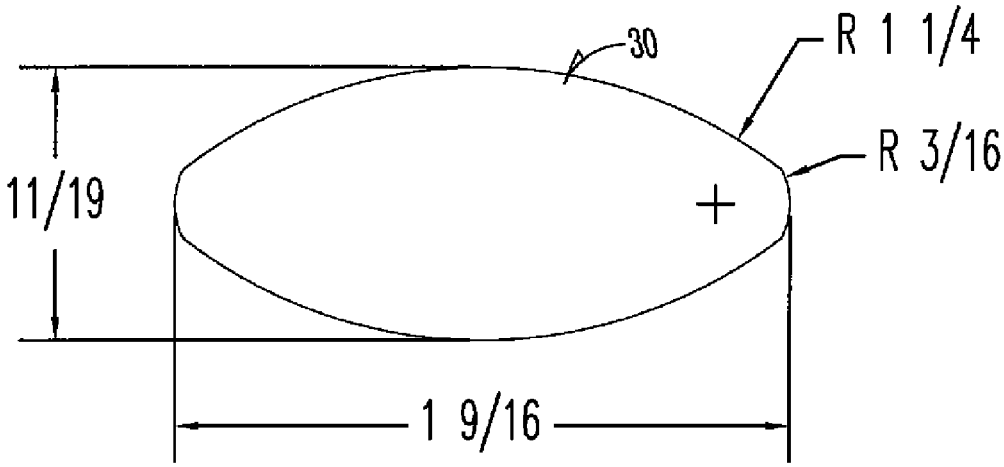
FIG. 4 is a top plan view of a cover adapted for connection over the top of the fastener pad of FIG. 3A to cover from sight the fastener and the structure of the fastener pad in FIG. 3A.

FIG. 4 illustrates what is called cover 30. As shown, it is shaped such that it fits over the head of the screw in opening 22 in fastener pad 20. In this embodiment, fastener pad 20 has a raised edge 24 around its perimeter. Cover 30 can have a perimeter that is slightly smaller than the inside perimeter of raised edge 24 so that it matingly fits within that edge 24. It then covers substantially fastener pad 20 including the exposed head of the screw. Cover 30 therefore is a much more aesthetically pleasing configuration and provides some resistance to water or chemicals that would otherwise be experienced by fastener pad 20 and its screw.

In this exemplary embodiment, the dimensions of cover 30 relative to fastener pad 20 are indicated on FIGS. 3A-C and FIG. 4. The composition of cover 30 can vary. In this embodiment, it is essentially a one millimeter thick vinyl pad. It is mylar allowing it to be somewhat flexible but durable with a metallic layer on its outer surface. It could be other materials (e.g., metal to match part 20). It can be adhesively mounted into fastener pad 20. The adhesive would be one that would maintain its adherence even through the years of conditions related to a shower environment.

Alternatively, of course, cover 30 could be configured to have a perimeter that matches or fit over the outer perimeter dimensions of fastener pad 20 and be adhered on top of that edge 24. It could also perhaps be interference fit within edge 24.

It does not have to have a metallic coating. It could be made of different materials of different properties.

Essentially cover 30 is an escutcheon.

Figure 5A:
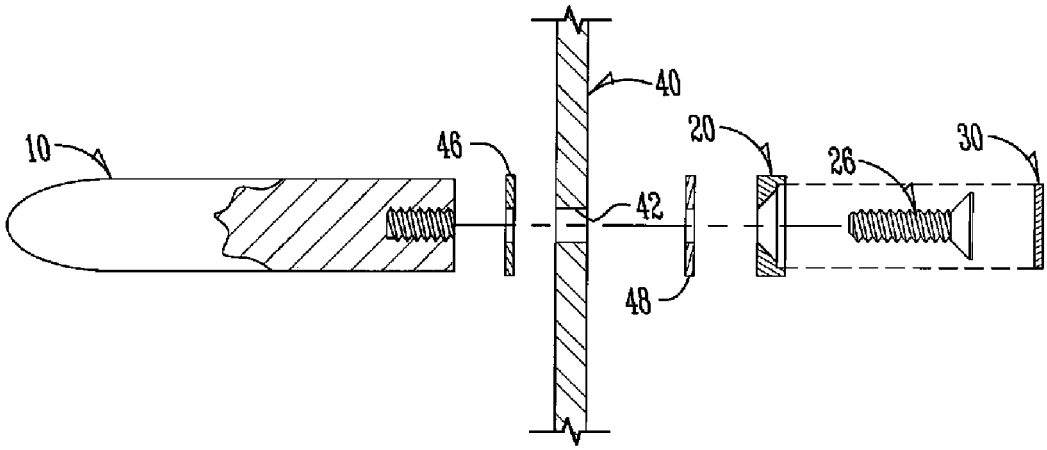
FIG. 5A is side elevational sectional view of an exploded version of an exemplary embodiment of the invention.
Figure 5B:
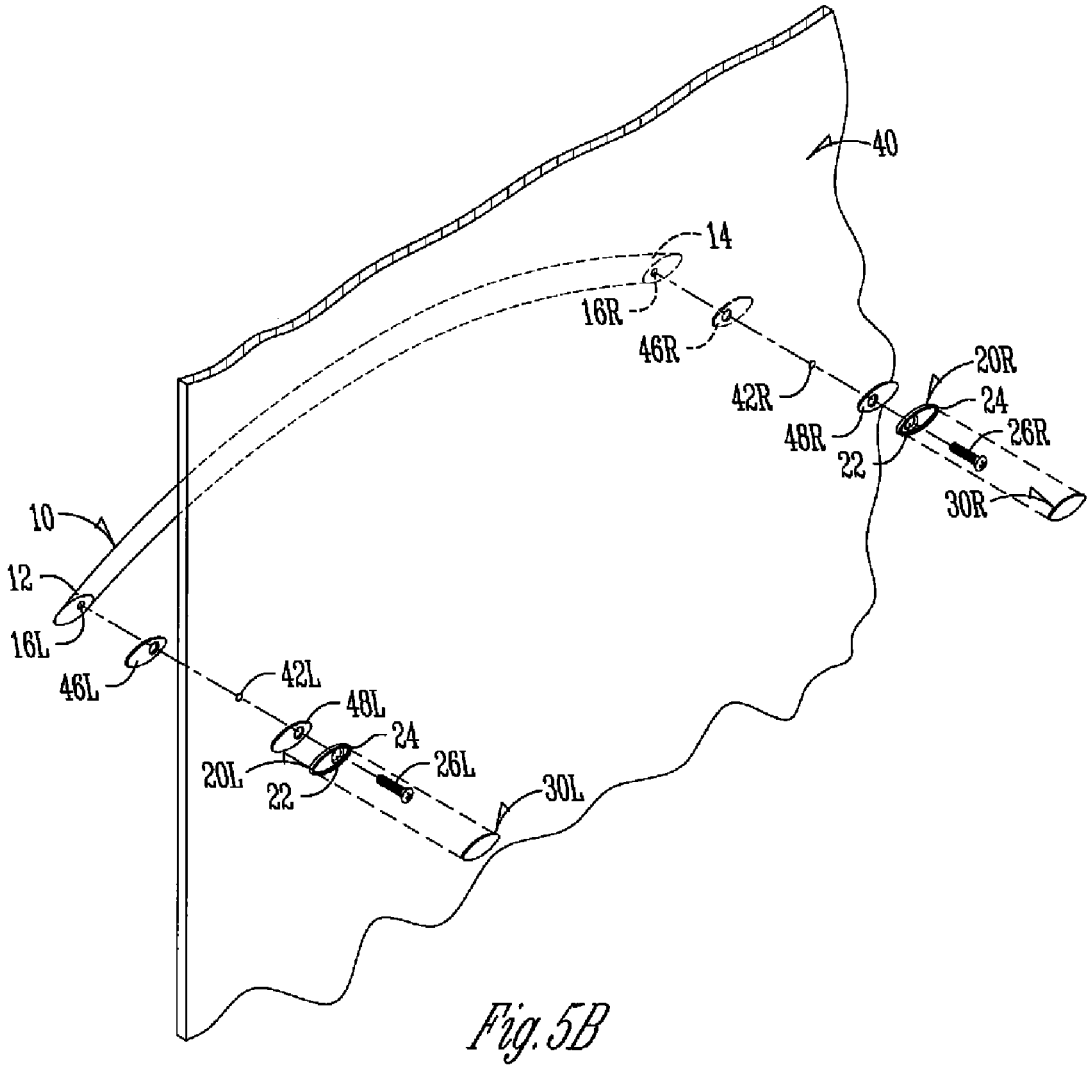
FIG. 5B is a perspective view of the embodiment of FIG. 5A.

FIG. 5A shows an elevational sectional view another view of the parts but relative to a glass pane 40. FIG. 5B shows the combination from a perspective view. Two holes 42 L and R are drilled or formed in glass pane 40 to match and align with threaded aperture 16 L and R of towel bar 10. Optionally plastic washers 46 and 48 can be inserted on opposite sides of openings 42 L and R and themselves have openings that can be aligned with the opening in the opening 16 L and R.

Figure 6A:
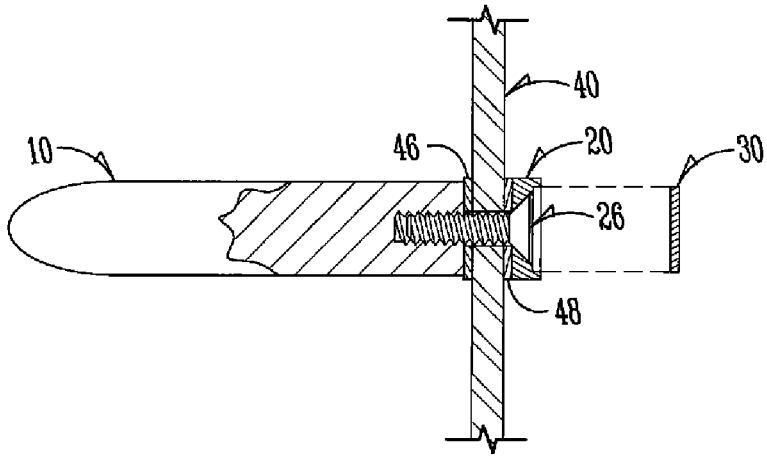
FIG. 6A is similar to FIG. 5A but shows the assembly assembled except for the escutcheon that covers the fastener on the exposed side of the panel.
Figure 6B:
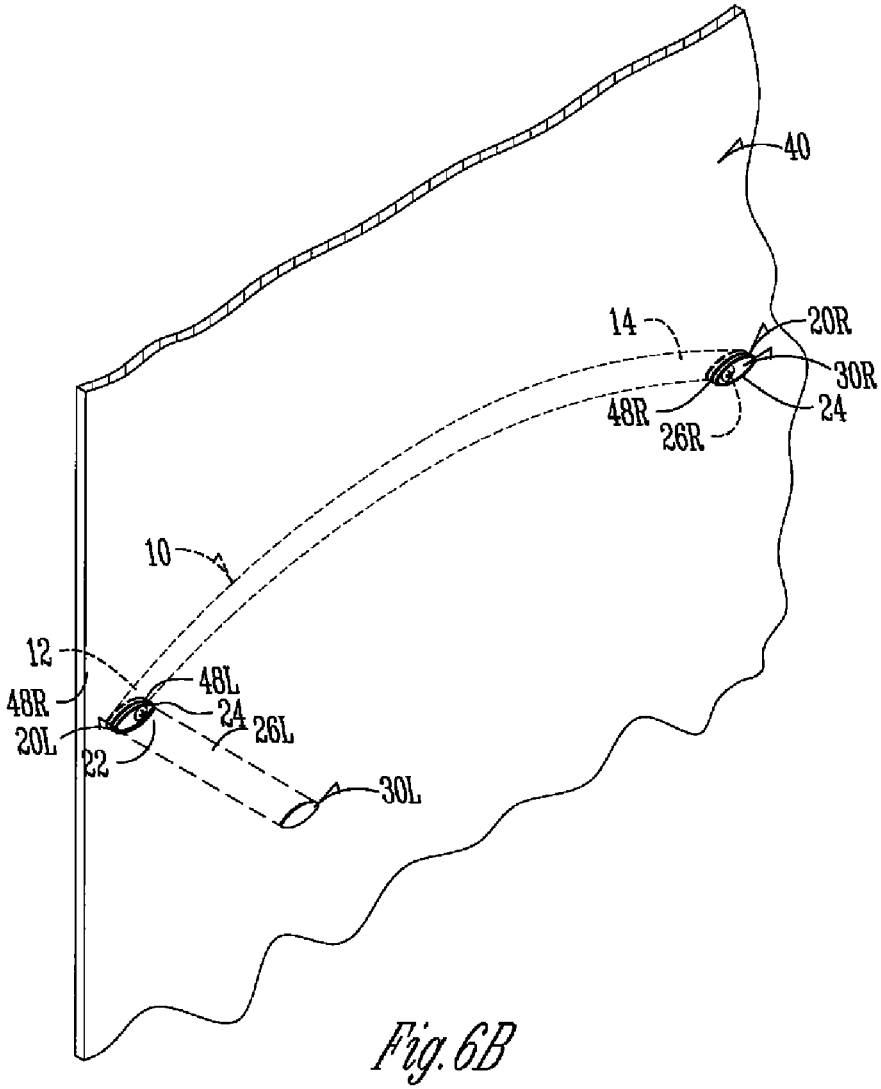
FIG. 6B is a perspective vie of FIG. 6A, showing better how fasteners are exposed before the escutcheons are mounted over them.
Figure 7:
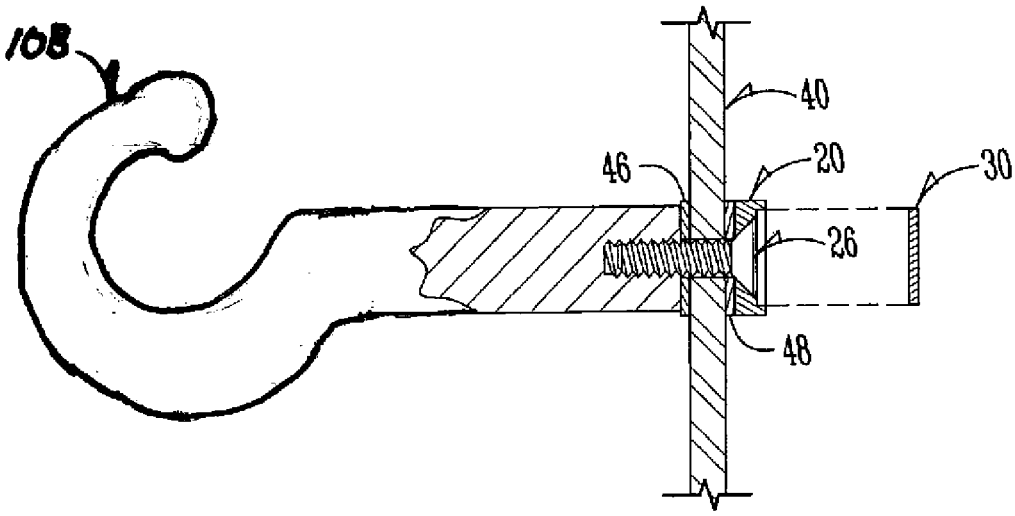
FIG. 7 is an alternative embodiment according to the present invention.

Fastener pads 20 L and R have countersinks to receive machine screw 26 such that its head is recessed from the outer surface of fastener pad 20. Covers 30 then are shaped to fit within edge 24 of fastener pads 20. FIGS. 6A and B show how the combination, except for cover pads 30, can be mounted on a glass panel. In particular, FIG. 6B illustrates that when the parts, except for covers 30 L and R are installed on the glass panel, the heads of machine screws 26 L and R would be visible from the side of glass panel 40 shown in FIG. 6B. Cover or escutcheon 30 is place able and securable over fasteners 26 L and R (see right side of FIG. 6B) to cover the machine screw 26 R to give it a much more pleasing and aesthetic appearance.

As can be appreciated, variations obvious to those skilled in the art can be included within the present invention. Covers 30 L and R could be made of material that matches the color and material and configuration of fastener pads 20 L and R. It could have adhesive preapplied with a release sheet such that they could simply be quickly installed on site.

It can be appreciated that cover 30 can take many forms and configurations and may just cover the fastener or cover substantial part or all of cover pad 20. They could be made of different materials and colors or textures.

What is claimed:

1. An assembly for mounting a device to one side of a door, pane, wall, or panel comprising:

a low-profile fastener pad comprising a relatively thin body having a perimeter, a thickness between proximal and distal sides, and an aperture through the thickness;

a mounting portion of a device comprising a proximal side having a perimeter and a receiver extending a depth into the mounting portion from the proximal side;

a fastener comprising a head with a width greater than the aperture of the fastener pad and a thickness on the same order of size as the thickness of the fastener pad and comprising a shaft with a width less than the aperture of the fastener pad and a length substantially greater than the thickness of the fastener pad;

a cover member adapted to be mounted over the head of the fastener on the distal side of the mounting pad when the fastener shaft is passed through the fastener pad aperture and the fastener head is at the fastener pad distal side, the cover member comprising an escutcheon having a thickness on the same order or less than the thickness of the fastener pad.

2. The assembly of claim 1 in combination with a device, wherein the device comprises hardware.

3. The assembly of claim 2 wherein the hardware comprises a towel bar.

4. The assembly of claim 2 wherein the hardware comprises a pull.

5. The assembly of claim 2 wherein the hardware comprises a hook.

6. The assembly of claim 1 wherein the fastener pad further comprises a raised edge.

7. The assembly of claim 1 wherein the fastener comprises a threaded fastener.

8. The assembly of claim 7 wherein the threaded fastener is a machine screw.

9. The assembly of claim 7 wherein the receiver of the mounting portion of the device comprises a threaded bore.

10. The assembly of claim 1 wherein the cover member has an adhesive on one side.

11. The assembly of claim 1 wherein the cover member is interference fit to the fastener pad.

12. The assembly of claim 1 wherein the cover member is configured to cover at least part of the fastener pad.

13. The assembly of claim 1 wherein the low profile fastener pad and cover are each relatively thin.

14. An escutcheon and clamping assembly for clamping a device to one side of a member such as a door, pane wall, or panel, comprising:

(a) a fastener comprising a head and shaft having a length;

(b) a relative thin-in-cross-section pad member including an opening through which the shaft but not the head of the fastener can pass, the pad member comprising a relatively thin body having proximal and distal sides, the body having a thickness substantially less than the length of the shaft;

(b) a relatively thin-cross-section cover member adapted to be mounted on the distal side of the pad member to cover the opening and fastener from sight, the cover member comprising an escutcheon having a thickness on the same order or less than the thickness of the mounting pad.

15. A method of mounting a device to one side of a door, pane, wall or panel by converging the device on one side of the door, pane, wall, or panel towards a low profile clamping pad member on an opposite side of the door, pane, wall, or panel by fastener extending through the door, pane, wall, or panel fastener having a portion exposed to view on the clamping pad member, said clamping pad member comprising a relatively thin body having proximal and distal sides, the body having a thickness substantially less than the thickness of the door, pane, or panel comprising:

after assembly of the device and clamping pad member with the fastener on opposite side of the door, pane, wall or panel, covering the exposed portion of the fastener on the distal side of the clamping pad member with an escutcheon having a thickness on the same order or less than the thickness of the mounting pad.

16. The method of claim 15 wherein the step of covering comprises additionally substantially covering at least a substantial of the clamping pad member.

17. The method of claim 15 wherein the step of covering comprises using an escutcheon having a thickness that is substantially less than the thickness of the clamping pad member.

18. The method of the claim 15 further comprising a second clamping pad member and an exposed fastener adapted to clamp the device to one side of the door, pane, wall, or panel, and further comprising covering the second exposed fastener at the second clamping pad member.

* * * * *

UNITED STATES PATENT AND TRADEMARK OFFICE

CERTIFICATE OF CORRECTION

PATENT NO. : 7,600,299 B2
APPLICATION NO. : 11/201224
DATED : October 13, 2009
INVENTOR(S) : Hendrickson It is certified that error appears in the above-identified patent and that said Letters Patent is hereby corrected as shown below:

Col. 4, Claim 14, Line 29:
DELETE after (b) a "relative"
ADD after (b) a --relatively--

Col. 4, Claim 14, Line 35:
DELETE "(b) a relatively thin-cross-section"
ADD --(c) a relatively thin-in-cross-section--

Col. 4, Claim 15, Line 45:
ADD after by --a--
ADD after panel --, the--

Col. 4, Claim 15, Line 50:
ADD after pane --wall--

Col. 4, Claim 15, Line 52:
DELETE after opposite "side"
ADD after opposite --sides--

Col. 4, Claim 16, Line 59:
ADD after stantial --portion--

Signed and Sealed this

Twenty-fifth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,600,299 B2
APPLICATION NO. : 11/201224
DATED : October 13, 2009
INVENTOR(S) : Joseph D. Hendrickson It is certified that error appears in the above-identified patent and that said Letters Patent is hereby corrected as shown below:

Title page (*) Notice

Delete "by 68 days" – and insert --by 147 days--

Signed and Sealed this

Twenty-fourth Day of August, 2010

David J. Kappos

David J. Kappos
*Director of the United States Patent and Trademark Office*